United States Patent [19]

Sigmund

[11] 4,163,311

[45] Aug. 7, 1979

[54] TIGHTENING SYSTEM FOR BLIND FASTENERS

[75] Inventor: Jerry A. Sigmund, Willow Grove, Pa.

[73] Assignee: SPS Technologies, Inc., Jenkintown, Pa.

[21] Appl. No.: 772,411

[22] Filed: Feb. 28, 1977

[51] Int. Cl.[2] ..... B25B 23/14

[52] U.S. Cl. ..... 29/407; 73/761; 173/12

[58] Field of Search ..... 173/1, 2; 73/139, 88 F, 73/761; 29/420, 407, 717

[56] References Cited

U.S. PATENT DOCUMENTS

| | | | |
|---|---|---|---|
| 3,962,910 | 6/1976 | Spyridakis et al. | 73/88 F |
| 3,973,434 | 8/1976 | Smith | 73/88 F X |
| 3,974,685 | 8/1976 | Walker | 73/88 F |
| 3,982,419 | 9/1976 | Boys | 73/88 F X |

*Primary Examiner*—Charles A. Ruehl
*Attorney, Agent, or Firm*—Aaron Nerenberg

[57] ABSTRACT

A tightening and control system is disclosed for automatically tightening a blind fastener assembly to a desired tightened condition in a workpiece, where the assembly is of the type which exhibits more than one installation region on a graph of two tightening characteristics during a complete tightening cycle. Typical of such assemblies are the types which first form an outwardly flared bulb adjacent the blindside surface of a workpiece and thereafter are tightened against the blindside surface to a predetermined clamp load condition. Such fasteners typically exhibit a curve of two related input tightening characteristics, such as torque and rotation, torque and time, or force and stroke. Each curve has a bulb forming region characterized by a generally linear portion followed by a marked drop off in the slope, an intermediate region, and a tightening region having a somewhat similar shape to the bulb forming region. Apparatus is generally disclosed for determining the gradient of the curve through which the assembly is being tightened, determining when a first condition indicative of having formed the bulb has occurred, and thereafter determining when the tightening should be discontinued at the desired tightened condition. In a preferred embodiment, the gradient is used to determine the occurrence of the first condition. The instantaneous force or torque value at this first condition is obtained and stored, and tightening is discontinued when the instantaneous force or torque bears some predetermined relationship to the corresponding force or torque value at the first condition.

43 Claims, 7 Drawing Figures

TIGHTENING SYSTEM FOR BLIND FASTENERS

BACKGROUND OF THE INVENTION

This invention relates generally to tightening and tightening control systems, and more particularly to systems for tightening fasteners which exhibit more than one installation region during a complete tightening cycle, such as, for example, blind fasteners.

In order to properly install a blind fastener into a workpiece hole, a first force or torque value must be reached in order to form the bulb, and a final tightening force or torque must be applied in order to tighten the fastener to the desired clamp load. These force or torque values may be referred to, respectively, as the bulb forming value and the final tightened value. The blind fasteners generally contemplated herein are of two types. The first type is a conventional two piece blind fastener including a pulling pin having an enlarged head at the blind (or inaccessible) end, and a tubular sleeve which is carried on the pin and is upset at the blindside workpiece surface when the pin is pulled in an axial direction, which causes the head to exert an axial force on the end of the sleeve. Examples of two-piece blind fasteners can be found in U.S. Pat. Nos. 3,253,495; 2,030,167; and 2,030,169. A second conventional type consists of three pieces including a pulling pin carrying a tubular sleeve, and a tubular expander having a tapered nose portion at one end. The expander is also carried on the pin with the tapered nose portion adjacent the sleeve. When an axial force is exerted on the pin by pulling or torquing, the sleeve advances over the tapered end of the expander and is radially outwardly expanded until the sleeve contacts the blindside workpiece surface and then forms an outwardly flared bulb. Examples of three-piece blind fasteners can be found in U.S. Pat. Nos. 3,643,544; 3,369,442; 3,063,329; 3,277,771; and 3,107,572. It should be noted that blind fasteners may generally be installed by pulling in an axial direction as shown in U.S. Pat. Nos. 3,253,495; 2,030,167; 2,030,169; 3,277,771; and 3,107,572, for example, or by exerting torque to move the pin in an axial direction as shown in U.S. Pat. Nos. 3,443,474; and 3,657,956.

Presently, there are no known adaptive automatic assembly tools for installing blind fasteners to a desired tightened condition responsive to the particular fastener assembly and joint being encountered. Installation tools such as shown in U.S. Pat. Nos. 3,643,544; 3,369,442; and 3,063,329 can install blind fasteners to a preload generally controlled by the breaking strength of a breakneck groove in the pulling pin. The breaking strength of this groove is dictated by the anticipated force necessary to form the bulb, and consequently this breaking strength must be greater than the bulb forming force. It should further be noted that the bulb forming force can vary with the grip length of the joint, friction in the joint/sleeve configuration and material, manufacturing tolerances, and squareness of the blindside surface with the axis of the fastener. Therefore, the breakneck strength must be established sufficiently high to accommodate these variables interacting to generate the highest bulb forming force. As a result, this force can have deleterious effects when the same variables interact to generate low bulb forming forces. Consequently, performance compromises of the fastener usually result. Additionally, there is also a problem of relaxation or recovery of clamping load in the joint after the pin breaks, causing inconsistencies in preload values from joint to joint in a structure. These and other problems are overcome by the present invention.

Referring to FIG. 1, the two force or torque vs. stroke or rotation curves shown for a typical blind fastener represent extremes of physical conditions which could be encountered in two separate joints in the same or different workpieces. No single force or torque value satisfies both conditions. For example, if the breaking strength of the pulling pin is set at a value corresponding to $[(F_S)B]$, fastener B may be tightened to the correct clamp load but this value will not be sufficient to form the bulb in Fastener A. Conversely, if the breaking strength of the pin is equal to a value $[(F_S)_A]$, undesirable formation or failure of the bulb forming member could occur in fastener B. It is this type of problem which has placed limitations on allowable joint and/or fastener manufacturing tolerances, resulting in increased costs to both the users and manufacturers of high performance blind fasteners. No automatic installation or tightening tools are currently known which can overcome these problems. These and other problems are, however, overcome by the present invention.

SUMMARY OF THE INVENTION

Accordingly, it is a general purpose and object of the present invention to provide a tightening and control system for reliably tightening an assembly to a desired tightened condition where the assembly includes a fastener which exhibits more than one installation region on a graph of two tightening characteristics during a complete tightening cycle. It is another object to provide a tightening and control system for reliably installing blind fasteners to a predetermined tightened condition into a variety of workpiece materials with minimum prior knowledge of the physical characteristics of the joint being tightened. It is still another object to provide a tightening and control system for installing blind fasteners to a desired tightened condition in a workpiece.

These and other objects are accomplished according to the present invention by apparatus and a method for installing a blind fastener in a workpiece hole to a final desired tightened condition including means for detecting a bulb forming characteristic of the blind fastener and means responsive to the bulb forming characteristic and at least one known characteristic of the blind fastener for determining the final desired tightened condition.

DESCRIPTION OF THE PREFERRED EMBODIMENTS

Figure 2:
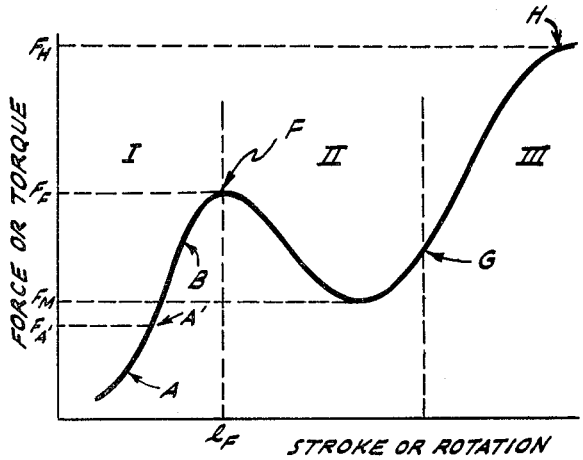
FIG. 2 is a graph of a typical force or torque vs. stroke or rotation curve of a blind fastener which exhibits more than one installation region.

FIG. 2 is a graph of force or torque vs. stroke or rotation showing a tightening curve for a typical blind fastener which exhibits more than one installation region. An installation region is generically defined as having a portion with a positive slope followed by a generally flat region (not shown) or a marked drop off in the slope. Throughout the following discussion it should be remembered that the present invention pertains to a blind fastener which exhibits multiple installation regions during a complete tightening cycle. Reference is made to my co-pending application Ser. No. 755,409 filed on Dec. 29, 1976 entitled "Tightening System", for a discussion of some of the problems dealt with herein, and the disclosure of my noted co-pending application is hereby incorporated by reference in this application.

In order to install blind fasteners to a clamp load lower than the bulb-forming force, for example, the present invention contemplates separate control over the bulb forming process and the final tightening process. Referring now to FIG. 2, region I represents the bulb forming region which is characterized by an initial portion below point A followed by a generally linear portion between points A and B, and a subsequent non-linear portion beyond point B. Point F on the curve adjacent the end of bulb forming region I represents the force or torque necessary to form the bulb in the sleeve. Point F then represents the achievement of a first condition just beyond the bulb-forming region, and the value at point F will be referred to as the bulb-forming force ($F_F$). For illustrative purposes, force will be discussed hereinafter, but it should be understood that torque could be used with equal accuracy. Region II is an intermediate or transition region in which the force applied generally begins to decrease almost immediately after reaching ($F_F$) and the curve initially assumes a negative slope or gradient in region II. It should be understood that the curve could remain generally flat for some amount of additional stroke after reaching point F, but this would not affect the operability or accuracy of the present invention, and accordingly it is not shown in FIG. 2 or dealt with further in this application. After some additional amount of stroke, the force stops decreasing and begins to increase, with the slope of the curve changing from negative to positive. When the slope becomes generally constant, at approximately point G, region III has been reached and final tightening of the blind fastener in the joint has begun. Region III identifies the final tightening region of the curve in which additional force is applied to the fastener in order to produce a final tightened condition at ($F_H$), for example. Stated in another way, a predetermined amount of tension load may be induced in the blind fastener at the desired tightened condition. This region of the curve includes a generally linear portion, as in the case of the generally linear portion of bulb forming region I. There is not necessarily any relationship between the relatively constant slopes of the generally linear portions in region I and region III. The slope in region III is determined in part by such factors as friction and sleeve strength due to hardness and thickness variations, among other factors. The fastener may be tightened to the desired tightened condition illustrated by point H on the curve, at which point further tightening is discontinued. For a complete discussion of certain points which will be referred to hereinafter, reference is made to U.S. Pat. No. 3,982,419 entitled "Apparatus For And Method Of Determining Rotational and Linear Stiffness" by John T. Boys, the disclosure of which patent is incorporated herein by reference.

Figure 3:
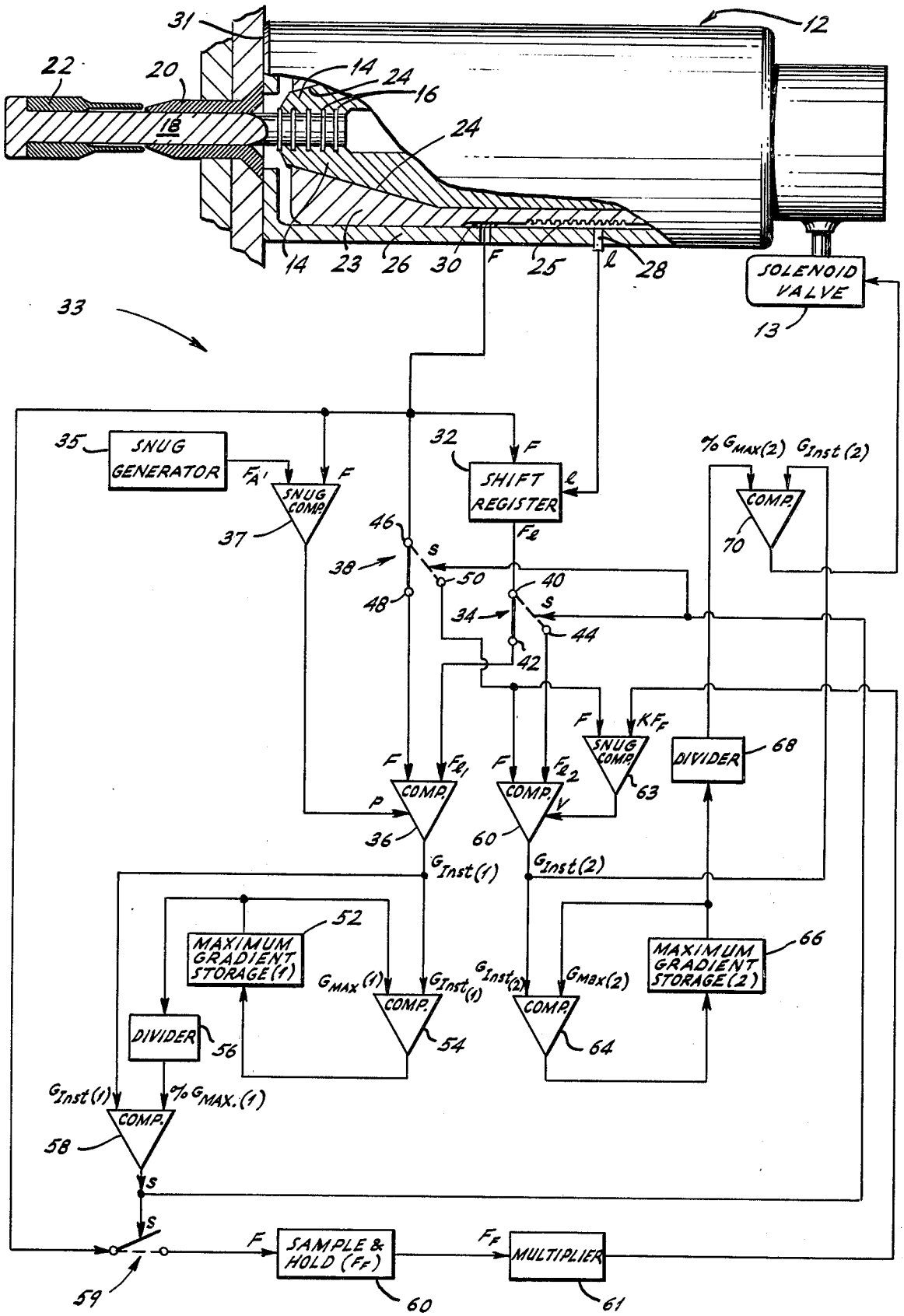
FIG. 3 is a partial cross-sectional view of a tightening tool and blind fastener including a schematic block diagram of a first embodiment of the invention.

One embodiment of the tightening and control system in accordance with the present invention is illustrated in FIG. 3. This system is a pull-type system utilizing force and stroke measurements. For illustration of a rotary system, reference is made to my above-referenced co-pending application which shows torque-applying apparatus usable with the present invention. Tightening system 10 includes blind fastener pulling tool 12 of the general type shown in U.S. Pat. No. 3,446,509, for example, driven by pneumatic or hydraulic power and controlled by a suitable electrically operated solenoid control valve 13. It should be understood that the tool could also be electrically driven, or driven by any combination of pneumatic, hydraulic or electric power. The exact details of the tool are not necessary for a proper understanding of the invention and, accordingly, a more specific description is not provided. A plurality of jaws 14 in the tool are designed to grip grooves 16 on a pulling pin 18 of the blind fastener assembly, which in the embodiment shown, also includes expander 20 and sleeve 22. Typically, the pulling tool includes at least three jaws which are disposed axially within the tool. Surrounding jaws 14 is an annular member 23 having a tapered surface 24 cooperating with a corresponding tapered surface on each of the jaws. Member 23 includes teeth 25 on a portion thereof facing an anvil 26. Mounted in anvil 26 adjacent teeth 25 is a proximity detector 28 for developing signals representative of the axial stroke of the blind fastener. Teeth 25 are illustrated as an example of one embodiment for detecting axial stroke, but it should be understood that a variety of suitable devices could be employed for accomplishing the same purpose. Proximity detector 28 senses the presence of metal and thus the passage of teeth 25, and develops an electrical signal representative of predetermined increments of axial stroke. Mounted on the surface of member 23 is a suitable strain gage 30 for measuring the axial force being experienced by the member and, thus, through jaws 14, the axial force on pulling pin 18. A strain gage could alternatively be mounted on each of jaws 14 and the values obtained therefrom averaged in some suitable manner, but the use of a single strain gage mounted on member 23 is deemed to be more practical.

Jaws 14 are shown in FIG. 3 in the closed or actuated position gripping grooves 16 on pulling pin 18 of the blind fastener assembly. The nose end 31 of the tool including anvil 26 must bear on the outside surface of expander 20 in the workpiece holes to provide proper reaction force during the pulling operation. Upon further actuation of the tool, jaws 14 driven by member 23 move rearwardly with respect to anvil 26, causing teeth 25 to move past proximity detector 28, whose output is proportional to the stroke of the tool. While one example of force and stroke measuring apparatus has been described, it should be understood that any of a variety of readily available devices for accomplishing the noted result can be utilized in accordance with the invention.

A control circuit 33 is operatively associated with tool 12 for controlling the installation of the fastener and includes a gradient calculating system that determines the instantaneous gradient or slope of the force-stroke or torque-rotation curve, which could be plotted on a graph if desired, for the particular fastener being tightened, and develops an electrical signal representative thereof. The gradient calculating system comprises a shift register 32 to which an instantaneous force signal (F) is fed and whose output is clocked by stroke signals (1) at fixed increments of stroke. Accordingly, the output ($F_l$) of shift register 32 is a signal representative of force a predetermined amount of axial stroke previous to the instantaneous stroke of the tool, and is fed through a conventional two position switch 34 into a comparator 36. Instantaneous force signals (F) from strain gage bridge 30 are fed through a conventional two position switch 38 to another input of comparator 36. Comparator 36, in the form of a suitable subtraction circuit, receives signal (F) and signal ($F_{ll}$) from shift register 32 and provides an output signal representative of the difference therebetween. Since force signals are subtracted over fixed increments of stroke, the output signal from comparator 36 is representative of the instantaneous gradient of the force-stroke curve in bulb forming region I of the tightening cycle.

While force and stroke have been selected for measurement in the present embodiment, it should be understood that torque and rotation or any other force or torque-related function such as fastener elongation, stress, motor speed, washer compression, force or torque gradient, etc., could be utilized, as well as any other function associated with the continued tightening of the fastener, such as time or strain, among others. Examples of some of these additional parameters which could be used for controlling the tightening of a blind fastener are described in U.S. Pat. No. 4,027,530 for "Simplified Apparatus For And Method Of Tightening Fasteners" by Angelo L. Tambini and Paul W. Wallace, and U.S. Pat. No. 4,023,406 for "Tightening System With Torque-Time Control" by John W. Benz, Jr.

In the first position of switch 34, contacts 40 and 42 are connected. As will be discussed more fully hereinafter, upon developing a control signal indicating that a first condition has been reached wherein the bulb forming force ($F_F$) has been generated, switch 34 will shift to the second position connecting contact 40 with a contact 44. Similarly, in the first position of switch 38, contact 46 is connected to a contact 48, while in the second position contact 46 is connected to a contact 50.

At this point it should be noted that while the force-stroke curve shown in FIG. 2 is generally linear from points A to B in region I, this portion of the curve may include temporary spikes which are caused by temporary seizing between the component parts of the blind fastener. Thus, the output of comparator 36, which would be a signal of constant magnitude if the force-stroke curve were exactly linear from point A to point B, may experience certain changes. Normally the gradient of the curve will be substantially constant from point A to point B (i.e., the curve will approximate to a straight line), but if this portion of the curve is not linear, the gradient will reach a typical maximum value. Accordingly, this portion may be considered as the generally linear portion of the curve. For this reason the gradient calculating system may include circuits for determining and storing the maximum gradient experienced up to any point along the force-stroke, that is, up to any point in bulb forming region I of the curve. In effect, the maximum gradient experienced in the generally linear portion of region I is normally considered to be the gradient for that region of the curve. Only the maximum gradient is stored and becomes the constant gradient of the generally linear portion of the curve, as will be more fully explained hereinafter. Accordingly, a storage circuit 52 is provided which circuit stores a signal representative of the maximum gradient so far encountered, and a comparator 54 is provided for comparing instantaneous gradient signals with the previously stored maximum gradient signal from storage circuit 52. If an instantaneous gradient signal [$G_{Inst\,(1)}$] is larger than a stored gradient signal [$G_{Max\,(1)}$], the instantaneous gradient signal is then stored in storage circuit 52. For a fuller description of storage circuit 52 and comparator circuit 54, reference is made to previously mentioned U.S. Pat. No. 3,982,419. It should be noted that in order to insure that the control system does not shut off prematurely prior to point A in the initial or pre-tightening portion of region I, computation of the torque gradient may be delayed until point A' on the generally linear portion of the curve is reached. Expressed in another way, stroke prior to "turn-on" point A' may be disregarded until a force value ($F_{A'}$) has been reached. Reference here is made to U.S. Pat. No. 3,974,883 for "Tightening System" by Jerry A. Sigmund, and more particularly to FIG. 3 and the explanation thereof for a fuller understanding of this point. In order to turn on the gradient computation circuitry at point A', a snug generator 35 may be employed to produce a signal indicative of a preset force value ($F_{A'}$) which might typically be approximately 20% to 50% of the anticipated bulb forming force value ($F_F$). The signal from generator 35 is introduced along with force signal (F) from the pulling tool to a comparator 37 in the form of a suitable subtraction circuit. When the instantaneous force value (F) equals the preset force value ($F_{A'}$), a signal (P) is issued to enable comparator 36 to begin determining the force gradient. Signal [$G_{Max\,(1)}$] from storage circuit 52, indicative of the maximum gradient in the generally linear portion of the curve, is fed into a divider circuit 56 where the maximum stored gradient value is divided by a predetermined fixed value to reduce the signal. Typically, the maximum gradient signal is reduced to between approximately 25% to 75% of the peak or maximum value, and generally to approximately ⅔ of the maximum value. The reduced signal from divider circuit 56 [$\%G_{Max\,(1)}$] is introduced along with the instantaneous gradient signal [$G_{Inst\,(1)}$] from comparator 36 into a comparator 58 in the form of a subtraction circuit. When the two input signals to comparator 58 are approximately equal, an output signal (S) is produced which is utilized to shift switches 34 and 38 to their respective second positions wherein contact 40 is connected to contact 44, and contact 46 is connected to contact 50. Output signal (S) indicates that the first condition in the bulb forming region has been reached. That is, point F, representative of the bulb forming force value ($F_F$) in FIG. 2 has been reached. Thereafter, transition region II must be passed before the final tightening region III is reached.

Figure 3A:
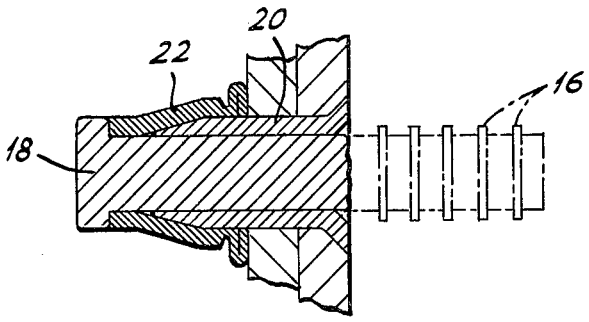
FIG. 3A is a cross-sectional view of the installed blind fastener.

Referring again to FIG. 3, when switches 34 and 38 are in their respective second positions, signals (F) from the tool and ($F_{l2}$) from shift register 32 are introduced into a comparator 60 which is similar in function to comparator 36. In order to avoid any inaccuracies in region III of FIG. 2, a second snug level may be established as a function of the bulb forming force ($F_F$). This is accomplished by determining the bulb forming force ($F_F$) and multiplying it by a fixed constant to establish the snug force value for tightening region III. Signal (S) from comparator 58 actuates a normally open single-throw switch 59 to a closed position, allowing output force signal (F) from the tool to pass to sample and hold circuit 60. Bulb forming force value ($F_F$) is stored and an output signal from circuit 60 indicative thereof is introduced into multiplier circuit 61 where it is multiplied by a fixed constant (K). Constant (K) may typically by any value between 0.5 and 1.5, depending on the characteristic shape of the force-stroke curve in region II and the type of joint being tightened. A preferably value of 1.1 may be used in most cases where the curve is similar to that in FIG. 2. Output signal ($KT_F$) from multiplier 61 is introduced into a snug comparator 63 in the form of a suitable subtraction circuit, the other input to comparator 63 being instantaneous force value (F). The output signal (V) from comparator 63 serves to delay computation of the instantaneous gradient [$G_{Inst}$ (2)] in comparator 60 until the second generally linear portion of the curve is reached as indicated by point G in FIG. 2. It should be understood, however, that utilization of the snug values is optional, and that the control system shown in the present embodiment could function without using snug signals (P) and (V) for turn on. The instantaneous gradient [$G_{Inst\,(2)}$] from comparator 60 is introduced into a comparator 64 along with a maximum gradient signal [$G_{Max\,(2)}$] from storage circuit 66, which is comparable to storage circuit 52. The maximum gradient signal is divided by a predetermined fixed constant in a divider circuit 68, which is similar to divider circuit 56, and the output signal from divider circuit 68 [$\%G_{Max\,(2)}$] is introduced along with the instantaneous gradient signal [$G_{Inst\,(2)}$] from comparator 60 into a comparator 70, which is similar to comparator 58. When the two signals are approximately equal, indicating that the final tightened condition, represented by point H in region III of the torque-rotation curve in FIG. 2 has been reached, comparator 70 produces a signal (Q) to solenoid valve 13 closing the valve and shutting off tightening system 10. It should be noted that the shut off point for the embodiment illustrated in FIG. 3 may typically be the yield point of the fastener assembly/joint combination. Standard tools are available for subsequently cutting off the exposed pintail either at the end of the installation or thereafter. FIG. 3A shows the fully installed blind fastener with the exposed pintail shown in phantom. It should be understood that once the blind fastener is installed to the desired clamp load, means must be provided to maintain that preload by fixing the axial position of pin 18 relative to expander 20. This may be accomplished in a variety of conventional ways such as, for example, by stuffing a collar (not shown) between the pin and the countersunk portion of the expander at the outside surface thereof, or providing a friction lock of some type between the outside surface of pin 18 and the inside surface of expander 20. In a threaded, rotating blind fastener assembly, numerous types of friction locking means can be provided between the mating threads, for example. As these methods of locking are conventional in the blind fastener art, further illustration and description are not provided.

Figure 4:
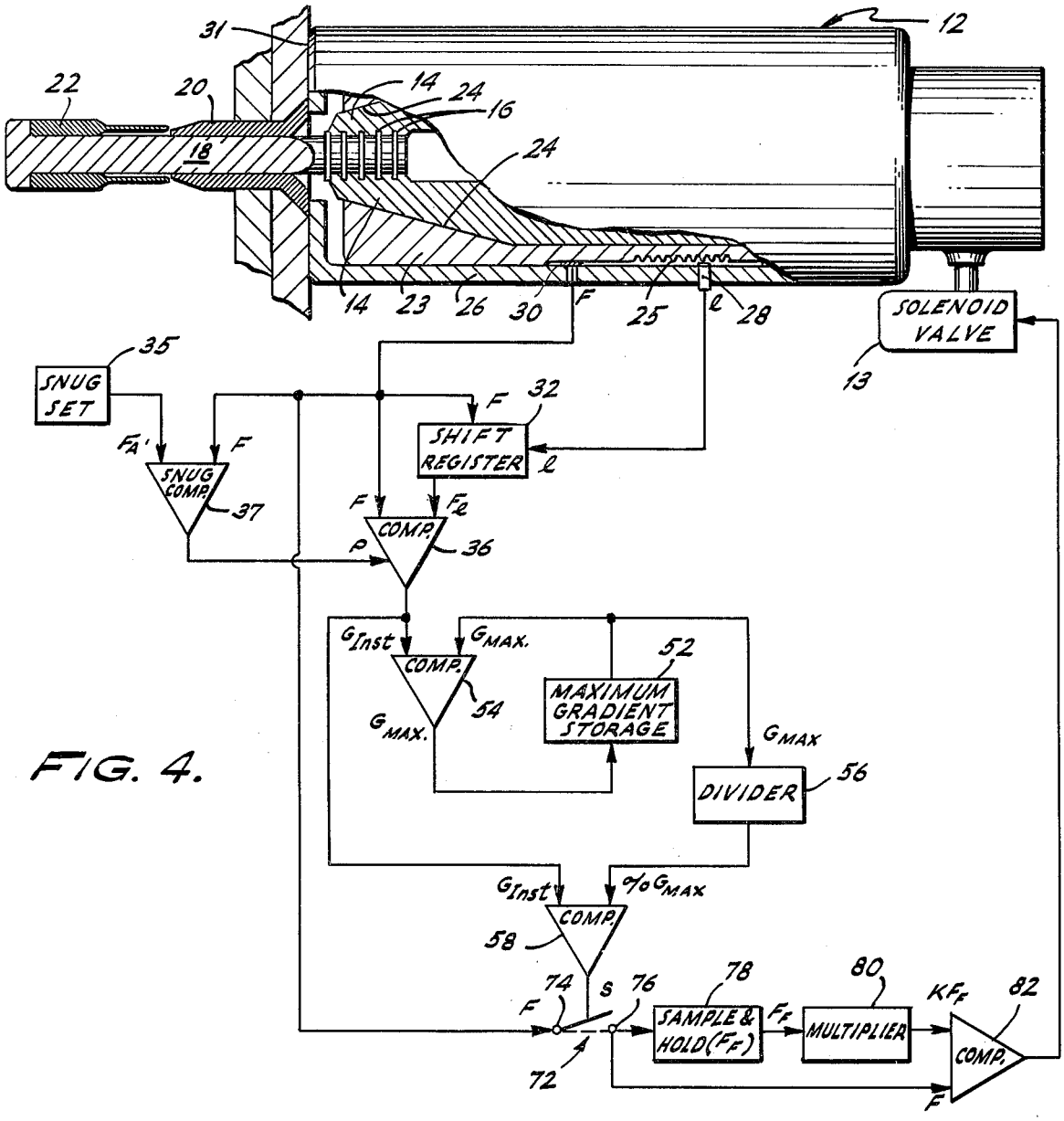
FIG. 4 is a view as shown in FIG. 3 including a schematic block diagram of a second embodiment of the invention.
Figure 1:
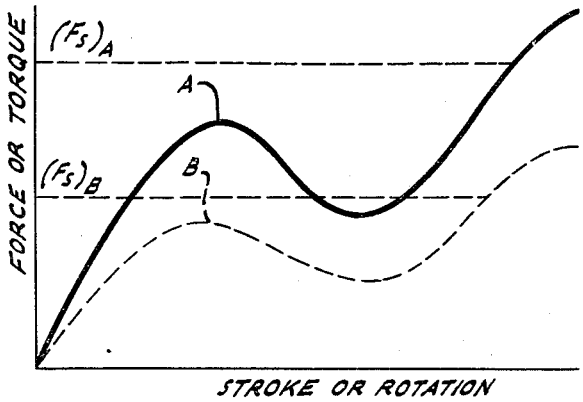
FIG. 1 is a graph of force or torque plotted against stroke or rotation illustrating extreme conditions of blind fastener installations.

Referring now to FIG. 4, a second embodiment of the present invention is illustrated. The system shown in FIG. 4 is similar to a portion of the system shown in FIG. 3 and accordingly like numerals will be used for like elements. The tightening and control system illustrated in FIG. 4 includes a pulling tool as described in the previous embodiment. Force (F) and stroke (l) measurements are fed into shift register 32 which produces an output signal ($F_l$) representative of force a predetermined amount of stroke previous to the instantaneous stroke of the blink fastener. Output signal ($F_l$) from shift register 32 is fed into comparator 36 along with instantaneous force signal (F). Comparator 36, being in the form of a subtraction circuit, produces a signal indicative of the instantaneous gradient ($G_{Inst}$) of the force-stroke curve through which the blind fastener is being tightened. As in the previous embodiment, a snug generator 35 can be introduced in order to disregard any inputs in the portion of the curve below point A in FIG. 2. The output signal from snug generator 35 ($F_{A'}$) is fed along with instantaneous force signal (F) to snug comparator 37 which issues an output signal (P) when the two values are approximately equal. Output signal (P) is used to enable comparator 36 in order to begin computation of instantaneous gradient ($G_{Inst}$). The maximum gradient ($G_{Max}$) experienced is stored in storage circuit 52 and is continuously compared with instantaneous gradient signal ($G_{Inst}$) in comparator 54. Maximum gradient signal ($G_{Max}$) is then divided in divider circuit 56, whose output signal ($\%G_{Max}$) is compared with instantaneous gradient signal ($G_{Inst}$) in comparator 58 to determine when bulb-forming force ($F_F$) in FIG. 2 is reached. Output signal (S) from comparator 58 is used to close a normally open, single throw switch 72. When switch 72 is closed, contacts 74 and 76 are connected allowing instantaneous force signal (F) to be introduced into a sample and hold circuit 78 which stores the instantaneous force value ($F_F$) at the first condition (point F in FIG. 2). The output from sample and hold circuit 78 ($F_F$) is introduced into a multiplier circuit 80 which multiplies the force value at the first condition by a fixed amount (K). This fixed value (K) could be determined in advance, for example, by experimental tests on joints similar to the type being tightened. A predictable ratio between bulb-forming force value ($F_F$) and the final clamp force value ($F_H$) at the final tightened condition, such as at the yield point of the fastener assembly, for example, exists in certain instances. For fastener assemblies which exhibit this predictable relationship, control based upon a final force value ($F_H$) which bears a relationship to the measured bulb-forming force value ($F_F$) will provide sufficient accuracy. It should be clear that a final tightened condition other than the yield point of the fastener assembly/joint combination could be chosen, such as, for example, a point less than ($F_F$) in FIG. 2 beyond and above the minimum value of force ($F_M$) reached in region II and bearing a relationship with bulb-forming force value ($F_F$). The output signal from multiplier circuit 80 ($KF_F$) is introduced along with instantaneous force (F) from contact 76 of switch 72 into a comparator 82 in the form of a suitable subtraction circuit. When the two values are approximately equal, an output signal (U) is produced by comparator 82 and fed into solenoid value 13 causing the valve to shut off the flow of fluid to tightening system 10. As previously discussed, the exposed pintail must then be cut off and pin member 18 fixed relative to expander 70 to complete the installation.

Figure 5:
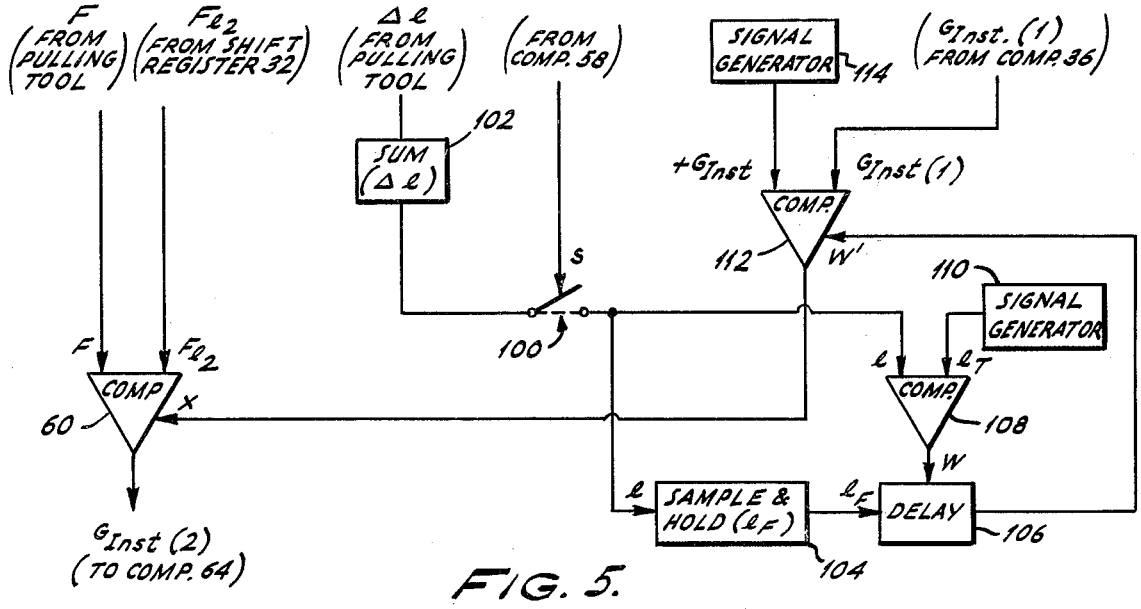
FIG. 5 is a partial schematic block diagram illustrating a third embodiment of the invention.
Figure 6:
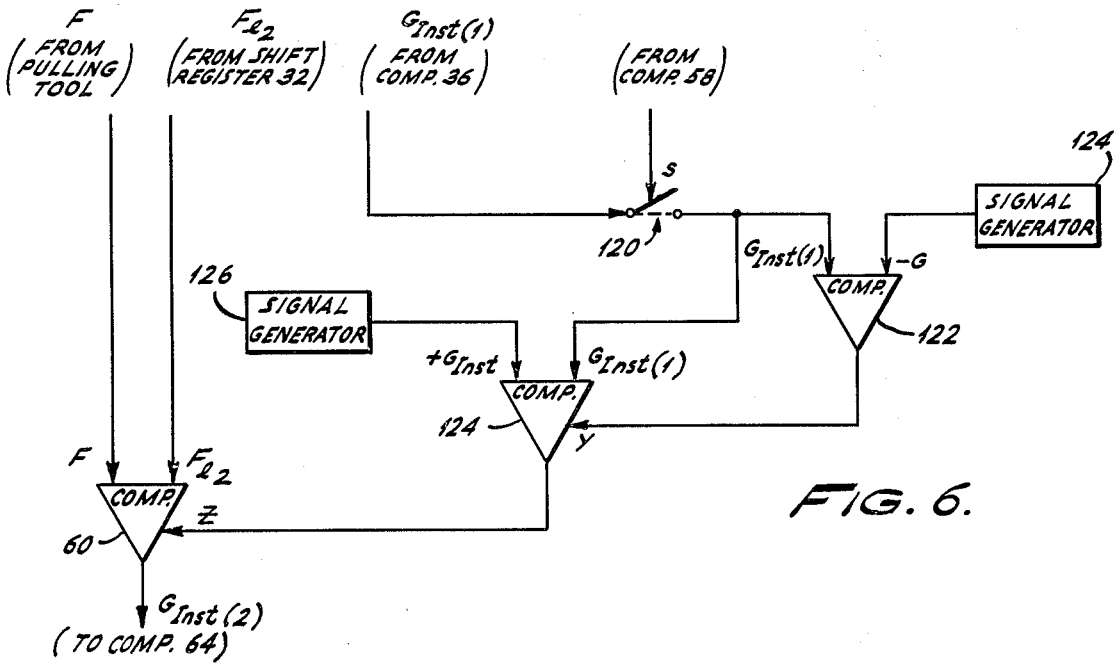
FIG. 6 is a partial schematic block diagram illustrating fourth and fifth embodiments of the invention.

In FIGS. 5 and 6, serveral more embodiments of the present invention are illustrated and will now be described. Each of the embodiments includes a tightening system 10 identical to the previously illustrated and described tightening system in FIG. 3. While each embodiment includes a control system similar to control system 31 in FIG. 3 utilizing force and stroke signals from the pulling tool, it should be understood that a wrench imparting torque and rotation could be used in certain instances and any of the control systems illustrated and described in previously mentioned U.S. Pat. Nos. 3,974,883, 3,982,419, 4,023,406 and 4,027,530 could be utilized instead. In this regard, the disclosures of the noted patents and patent applications are incorporated herein by reference. It should further be understood that any control system for sensing a desired point on a curve of two variables of the type shown in FIG. 2 could be utilized as well. In the event that input tightening characteristics other than force and stroke are utilized, then these parameters may be readily substituted, as described in the noted patents and patent applications.

For example, in order to use the control parameters torque and time (or force and time as the case might be), as disclosed in U.S. Pat. No. 4,023,406 to Benz in a rotary system, such as disclosed in U.S. Pat. No. 3,982,419 to Boys and in my co-pending patent application Ser. No. 755,409, teeth 25 and proximity detector 28 are eliminated from the control systems illustrated in FIGS. 3 and 4, and these elements are replaced by oscillator 34 illustrated in FIG. 2 of the Benz patent. Accordingly, in FIG. 5, the Δl signals to summing circuit 102 would originate from oscillator 34 in the Benz patent instead of from the pulling tool (i.e. proximity detector 28) as labeled.

In order to utilize the control parameters motor speed and rotation (or motor speed and stroke as the case might be) as disclosed in U.S. Pat. No. 4,027,530 to Tambini et al. in a rotary system, the following direct substitutions would have to be made. In the first two embodiments, strain gage 30 and shift register 32 would be eliminated from FIGS. 3 and 4, and these elements would be replaced by oscillator 30, gate 32, D/A convertor 34, delay circuit 36, sample and hold circuit 38 and shift register 40 from FIG. 2 of the Tambini et al patent. An input " $_i$" from D/A convertor 34 of FIG. 2 of the Tambini et al. patent would replace all inputs of instantaneous force "F" from strain gage 30 to comparator 37 and switch 72 in FIG. 4. In a third embodiment, strain gage 30, shift register 32 and comparator 36 would be eliminated from FIG. 4 and be replaced by oscillator 60, gate 62, D/A convertor 64, delay circuit 66, sample and hold circuit 68 and differentiator 70 from FIG. 3 of the Tambini et al patent. In this embodiment, an input " $'_i$" from D/A convertor 64 would replace all inputs of instantaneous force "F" from strain gage 30 to comparator 37 and switch 72 in FIG. 4. The output from comparator 37 would then be fed to differentiator 70 instead of to the eliminated comparator 36. In the last embodiment, strain gage 30 and shift register 32 would be eliminated from FIG. 3 and be replaced by oscillator 60, gate 62, D/A convertor 64, delay circuit 66 and sample and hold circuit 68 from FIG. 3 of the Tambini et al. patent. Also, comparators 36 and 60 would be eliminated from FIG. 3 and be replaced by a pair of differentiators 70 from FIG. 3 of the Tambini et al patent. Accordingly, an input " $_i$" from D/A convertor 64 would replace all inputs of instantaneous force "F" from strain gage 30 to comparator 37 and switches 38 and 59 in FIG. 3. Comparator 37 would, in this embodiment, output a signal to one of the differentiators 70 in series with switch 38 and comparator 63 would similarly output a signal to the other one of differentiators 70. In FIGS. 5 and 6, the "F" signals to respective comparators 60 would be replaced by " $_i$" signals from D/A convertor 34 in FIG. 2 or by " $'_i$" signals from D/A convertor 64 in FIG. 3 of the Tambini et al. patent, instead of from the pulling tool (strain gage 30) as labeled.

Referring now to FIG. 5, an embodiment is shown in which the stroke ($\mathbf{1}_F$) at the bulb-forming force ($F_F$) is determined, a fixed amount of stroke beyond ($\mathbf{1}_F$) is allowed to pass, and thereafter a minimum positive gradient must be sensed before the control circuit is activated to determine the final tightened condition. It should be understood that the control circuit in the present embodiment is similar to that shown in FIG. 3, with the exception of the snug-sensing, turn-on circuitry in region III. Output signal (S) from comparator 58, indicative of having reached point F in FIG. 2, closes a normally open, single-throw switchh 100, allowing stroke signal (1) from a summing circuit 102 to pass to a sample and hold circuit 104. Incremental stroke pulses (Δ1) from the pulling tool are summed in circuit 102 to provide stroke signal (1). The stroke signal ($\mathbf{1}_F$) at bulb-forming point F is stored in circuit 104, and an output signal therefrom is introduced into a delay circuit 106 which also receives a signal (W) from a comparator 108. Comparator 108, in the form of a suitable subtraction circuit, receives stroke signal (1) from summing circuit 102 and a signal ($\mathbf{1}_T$) representative of a fixed amount of stroke beyond ($\mathbf{1}_F$) from a signal generator 110, and outputs signal (W) when the two input signals are approximately equal. Signal generator 110 is set to a fixed value which may be conveniently determined from tests made upon joints of the type being tightened. Upon receiving signal (W), delay circuit 106 passes a signal (W') to enable a comparator 112 in the form of a subtraction circuit, which also receives the instantaneous gradient signal [$G_{Inst\ (1)}$] from comparator 36 (FIG. 3) and a preset, positive gradient signal [$+G_{Inst}$] from a signal generator 114. The value from signal generator 114 is the minimum positive gradient which must be sensed before the control circuit is activated to determine the final tightened condition, such as point H in region III of FIG. 2, or any point beyond ($F_M$). This minimum positive gradient value may also be determined from tests conducted on fastener assembly/joint combinations similar to the type being tightened. It should be pointed out that a suitable, conventional circuit would have to be used in the present embodiment in order to continue to receive signals [$G_{Inst\ (1)}$] from comparator 36 after signal (S) has been produced. Since this desired result is considered to be readily achieved by elementary circuit design, no further explanation will be included. When the two input signals to comparator 112 are approximately equal, an output signal (X) is produced to enable comparator 60 (FIG. 3), which receives instantaneous force signals (F) from the pulling tool and signals ($F_{l2}$) from shift register 23. Signal (X) is thus the signal which "turns on" the control system in tightening region III. The remainder of the control system functions in the same manner as described with respect to FIG. 3.

With reference to FIG. 6, an embodiment is illustrated in which a negative gradient is sought after reaching bulb-forming force ($F_F$), and thereafter, the control circuit is activated upon sensing a minimum positive gradient. As in the previous embodiment of FIG. 5, it should be understood that the control circuit in the present embodiment is the same as that illustrated in FIG. 3 with the exception of the snug-sensing, turn-on circuitry in region III. Output signal (S) from comparator 58 closes a normally open, single-throw switch 120, allowing instantaneous gradient signal [$G_{Inst\ (1)}$] from comparator 36 to pass to one input of a comparator 122 in the form of a suitable subtraction circuit. The other input to comparator 122 is a negative signal (−G) from a signal generator 124, representative of a finite negative gradient signal. When the force-stroke curve for the joint being tightened assumes a negative slope, and gradient signal [$G_{Inst\ (1)}$] generally equals the negative signal (−G) from signal generator 124, an output signal (Y) is developed. Signal (Y) is used to enable a comparator 124 which receives instantaneous gradient signal [$G_{Inst\ (1)}$] and a signal ($+G_{Inst}$) indicative of a minimum positive gradient from a signal generator 126. The value of such a minimum positive gradient may conveniently be determined from tests conducted on fastener assembly/joint combinations similar to the type being tightened. Upon reaching the minimum positive gradient, comparator 124 outputs a signal (Z) to enable comparator 60, which determines the gradient [$G_{Inst\ (2)}$] in tightening region III of FIG. 2, as previously described with respect to the control circuit in FIG. 3.

Having thus described several embodiments of the present invention, it should be apparent that there have been disclosed several systems for tightening an assembly including a blind fastener, which exhibits more than one installation region, to an accurate predetermined tightened condition in a variety of joints encountered. The blind fastener may be a pull-type as described in the embodiments illustrated, or may be of the type which requires torque to install. The final tightened condition may be the yield point of the joint including the blind fastener assembly or any desired clamp load less than the yield point. The systems described are reliable, accurate, relatively inexpensive to manufacture, and require only a minimum amount of prior knowledge about the particular blind fastener assembly/joint combination being tightened. The present invention provides a long felt need in the field of automated tightening systems for blind fasteners.

While in the foregoing there have been disclosed several embodiments of tightening and control systems in accordance with the present invention, various changes and modifications should be readily apparent to one skilled in the art and are within the intended scope of the invention as recited in the claims.

I claim:

1. Apparatus for tightening an assembly to a predetermined tightened condition, the assembly including a fastener which exhibits more than one installation region on a curve of two input tightening characteristics which vary with respect to each other and which could be plotted for the assembly being tightened during a complete tightening cycle, the apparatus comprising:

means for applying said input tightening characteristics to the fastener wherein said input tightening characteristics are force and stroke;

means for developing signals indicative of said input tightening characteristics;

first means receiving said input tightening characteristic signals for determining when at least one of said signals has reached a first condition indicative of the assembly having surpassed the first installation region and producing an output signal indicative thereof;

second means responsive to said first means output signal for determining when the assembly has been tightened to the predetermined tightened condition in a subsequent installation region and for developing a control signal indicative thereof; and means responsive to said control signal for discontinuing the application of said input tightening characteristics to the fastener.

2. Apparatus in accordance with claim 1 wherein said first means includes means responsive to said input tightening characteristics signals for developing a signal representative of the instantaneous gradient of said input tightening characteristics curve, and means responsive to said instantaneous gradient signal for determining a significant change in slope in the first installation region on the curve of said input tightening characteristics, said means responsive to said gradient signal including means for storing said instantaneous gradient signal in the first installation region and for developing a signal indicating that said first condition has been reached when said instantaneous gradient signal is a predetermined percentage of said stored signal.

3. Apparatus in accordance with claim 2 wherein said stored signal is representative of the maximum gradient in the first installation region of the curve of said input tightening characteristics.

4. Apparatus in accordance with claim 3 wherein said second means determines the instantaneous force value at the first condition and develops said control signal indicative of the assembly having been tightened to the predetermined tightened condition when the instantaneous force value bears a predetermined relationship relative to said instantaneous force value at the first condition.

5. Apparatus in accordance with claim 1 wherein said means for applying input tightening characteristics to the fastener includes means for exerting a generally axial pulling force on said fastener.

6. Apparatus in accordance with claim 1 wherein the fastener is a blind fastener.

7. Apparatus for tightening an assembly to a predetermined tightened condition, the assembly including a blind fastener and workpiece combination wherein a curve of two input tightening characteristics which vary with respect to each other and which could be plotted for the assembly being tightened during a complete tightening cycle exhibits a bulb-forming region and a tightening region separated by a transition region, the apparatus comprising:

means for applying said input tightening characteristics to the blind fastener;

means for developing signals indicative of said input tightening characteristics;

first means responsive to said input tightening characteristic signals for developing a signal representative of the instantaneous gradient of said input tightening characteristics curve through which the assembly is being tightened;

second means responsive to said first means instantaneous gradient signal for determining a significant change in slope in the bulb-forming region on said curve and developing a signal indicating that a first condition has been reached;

third means responsive to said first condition signal for determining when the tightening region has been reached and developing a signal representative thereof;

fourth means enabled by said third means signal and responsive to said input tightening characteristic signals for developing a signal representative of the instantaneous gradient of said curve in the tightening region;

fifth means responsive to said fourth means instantaneous gradient signal for determining a significant change in slope in the tightening region and developing a control signal indicating that the predetermined tightened condition of the assembly has been reached; and means responsive to said control signal for discontinuing the application of input tightening characteristics to the blind fastener.

8. Apparatus in accordance with claim 7 wherein said third means includes means for determining the instantaneous value of one of said input tightening characteristics at said first condition, multiplying means for multiplying the value of said one of said input tightening characteristic signals at said first condition by another value, and comparator means receiving the multiplied value of said one of said input tightening characteristic signals and the instantaneous value of said one of said input tightening characteristic signals for developing an output signal when said input signals thereto are approximately equal, said comparator means output signal being said third means signal.

9. Apparatus in accordance with claim 8 wherein said one of said input tightening characteristics is force.

10. Apparatus in accordance with claim 7 wherein said third means includes determining means for determining the instantaneous value of one of said input tightening characteristics at said first condition and developing a signal representative thereof, delay means for delaying passage of said determining means signal for a fixed additional amount of said one of said input tightening characteristics, signal generating means for developing a signal representative of a fixed positive gradient and comparator means enabled by said delayed determining means signal and receiving said first means gradient signal and said fixed positive gradient signal for developing an output signal when said input gradient signals thereto are approximately equal, said comparator means output signal being said third means signal.

11. Apparatus in accordance with claim 10 wherein said one of said input tightening characteristics is stroke.

12. Apparatus in accordance with claim 11 wherein said delay means includes signal generating means for producing an output signal indicative of a fixed amount of stroke and comparator means receiving said signal generating means output signal and a signal representative of the stroke of the blind fastener for developing an output signal when the input signals thereto are approximately equal, said delay means receiving said determining means signal and being clocked by said comparator means output signal in order to pass said determining means signal.

13. Apparatus in accordance with claim 7 wherein said third means includes first signal generating means for developing a signal representative of a finite negative gradient, first comparator means receiving said first means gradient signal and said finite negative gradient signal for developing an output signal when said input gradient signals are essentially equal, second signal generating means for developing a signal representative of a fixed positive gradient, and second comparator means enabled by said first comparator means output signal and receiving said first means gradient signal and said fixed positive gradient signal for developing an output signal when said input gradient signals thereto are approximately equal, said second comparator means output signal being said third means signal.

14. Apparatus in accordance with claim 7 wherein said third means includes signal generating means for developing a signal representative of a fixed positive gradient and comparator means receiving said first means gradient signal and said fixed positive gradient signal for developing an output signal when said input gradient signals thereto are approximately equal, said comparator means output signal being said third means signal.

15. Apparatus in accordance with claim 7 wherein said second means include means for storing said first means instantaneous gradient signal and for developing said first condition signal when said instantaneous gradient signal is a predetermined percentage of said stored signal.

16. Apparatus in accordance with claim 15 wherein said fifth means include means for storing said fourth means instantaneous gradient signal and for developing said control signal when said instantaneous gradient signal is a predetermined percentage of said stored signal.

17. Apparatus in accordance with claim 16 wherein said stored second means signal is representative of the maximum gradient in the bulb-forming region, and wherein said stored fifth means signal is representative of the maximum gradient in the tightening region.

18. Apparatus in accordance with claim 17 wherein said input tightening characteristics are force and stroke.

19. Apparatus in accordance with claim 17 wherein the fastener is of a type installed by means of an input torque and said input tightening characteristics are torque and rotation.

20. Apparatus in accordance with claim 17 wherein the fastener is of a type installed by means of an input torque and said input tightening characteristics are torque and time.

21. Apparatus in accordance with claim 17 wherein the fastener is of a type installed by means of an input torque and said means for applying input tightening characteristics include motor-driven wrench means, and said input tightening characteristics are motor speed and rotation.

22. A method of tightening an assembly to a predetermined tightened condition, the assembly including a fastener which exhibits more than one installation region during a complete tightening cycle, comprising the steps of:

applying input tightening characteristics to the fastener wherein said input tightening characteristics are force and stroke;

developing signals indicative of said input tightening characteristics;

determining when at least one of said input tightening characteristic signals has reached a first condition indicative of the assembly having surpassed the first installation region;

determining when the assembly has been tightened to the predetermined tightening condition in a subsequent installation region as a function of said first condition, and developing a control signal indicative thereof; and discontinuing the application of input tightening characteristics to the fastener in response to said control signal.

23. A method in accordance with claim 22 wherein said first condition is determined by developing a signal representative of the instantaneous gradient of a curve of said input tightening characteristics through which the assembly is being tightened which curve could be plotted for said input tightening characteristics, and determining a significant change in slope in the first installation region on the curve of said input tightening characteristics by storing said instantaneous gradient signal in the first installation region and developing a signal indicating that said first condition has been reached when said instantaneous gradient signal is a predetermined percentage of said stored signal.

24. A method in accordance with claim 23 wherein said stored signal is representative of the maximum gradient in the first installation region of the curve of said input tightening characteristics.

25. A method in accordance with claim 24 wherein said input tightening characteristic signal determined is an instantaneous force value at the first condition, and said control signal indicative of the assembly having been tightened to the predetermined tightened condition is developed when the instantaneous force value bears a predetermined relationship relative to said instantaneous force value at the first condition.

26. A method in accordance with claim 22 wherein said input tightening characteristics are applied to the fastener by means which exert a generally axial pulling force on said fastener.

27. A method in accordance with claim 22 wherein the fastener is a blind fastener.

28. A system for installing a blind fastener in a workpiece hole to a final desired tightened condition comprising:

means for detecting a bulb-forming characteristic of the blind fastener; and means responsive to said bulb-forming characteristic and at least one known characteristic of the blind fastener for determining the final desired tightened condition.

29. A system in accordance with claim 28 wherein the final desired tightened condition is the desired clamp load.

30. A system in accordance with claim 29 wherein said at least one known characteristic of the blind fastener is a predetermined ratio of the desired clamp load to the bulb-forming force.

31. A system in accordance with claim 28 wherein said bulb-forming characteristic is the force to form the bulb.

32. A system in accordance with claim 28 wherein said bulb-forming characteristic is the stroke required to form the bulb.

33. A system in accordance with claim 28 wherein the fastener is of a type installed by means of an input torque and said bulb-forming characteristic is the torque necessary to form the bulb.

34. A system in accordance with claim 28 wherein the fastener is of a type installed by means of an input torque and said bulb-forming characteristic is the rotation necessary to form the bulb.

35. A system in accordance with claim 28 wherein said at least one known characteristic of the blind fastener is a predetermined amount of additional stroke after forming the bulb to reach the final desired tightened condition.

36. A method of determining a final desired tightened condition of a blind fastener in a workpiece hole during installation comprising the steps of:

producing a signal indicative of an input tightening characteristic of the blind fastener being installed;

detecting a bulb-forming characteristic of the blind fastener; and determining the final desired tightened condition in response to said bulb-forming characteristic and a predetermined value of said input tightening characteristic signal of the blind fastener being installed.

37. A method in accordance with claim 36 wherein the final desired tightened condition is the desired clamp load.

38. A method in accordance with claim 37 wherein said predetermined value of said input tightening characteristic of the blind fastener being installed is a predetermined ratio of the desired clamp load to the bulb-forming force.

39. A method in accordance with claim 36 wherein said bulb-forming characteristic is the force required to form the bulb.

40. A method in accordance with claim 36 wherein said bulb-forming characteristic is the stroke required to form the bulb.

41. A method in accordance with claim 36 wherein the fastener is of a type installed by means of an input torque and said bulb-forming characteristic is the torque necessary to form the bulb.

42. A method in accordance with claim 36 wherein the fastener is of a type installed by means of an input torque and said bulb-forming characteristic is the rotation necessary to form the bulb.

43. A method in accordance with claim 36 wherein said predetermined value of said input tightening characteristic of the blind fastener being installed is a predetermined amount of additional stroke after forming the bulb to reach the final desired tightened condition.

* * * * *